US005911358A

United States Patent [19]

Kenner et al.

[11] Patent Number: 5,911,358

[45] Date of Patent: Jun. 15, 1999

[54] FOLDING BOX

[75] Inventors: Ralf Kenner, Pleidelsheim, Germany; Wayne Loprete, Crugers, N.Y.

[73] Assignee: CD Cartondruck GmbH, Obersulm, Germany

[21] Appl. No.: 09/022,916

[22] Filed: Feb. 12, 1998

[30] Foreign Application Priority Data

May 31, 1997 [DE] Germany ..... 297 09 510 U
Oct. 2, 1997 [EP] European Pat. Off. ..... 97117122

[51] Int. Cl.[6] ..... B65D 5/48

[52] U.S. Cl. ..... 229/116.1; 229/4.5; 229/128

[58] Field of Search ..... 229/4.5, 116.1, 229/117.01, 117.06, 128, 185.1, 902, 906; D9/433

[56] References Cited

U.S. PATENT DOCUMENTS

| | | | |
|---|---|---|---|
| 2,964,227 | 12/1960 | Goldsholl | 229/4.5 |
| 3,010,571 | 11/1961 | Transport | 229/128 |
| 3,637,130 | 1/1972 | Farquhar | 229/128 |
| 3,765,594 | 10/1973 | Cramphorn | 229/128 |
| 3,929,222 | 12/1975 | Smith et al. | 229/128 |
| 3,964,606 | 6/1976 | Hogg et al. | 229/128 |
| 4,083,447 | 4/1978 | Walters et al. . | |
| 4,109,848 | 8/1978 | Kipp et al. | 229/4.5 |
| 5,061,501 | 10/1991 | Lowe | 229/128 |

FOREIGN PATENT DOCUMENTS

| | | | |
|---|---|---|---|
| 1 024 872 | 2/1958 | Germany . | |
| 796271 | 6/1958 | United Kingdom | 229/128 |

*Primary Examiner*—Gary E. Elkins
*Attorney, Agent, or Firm*—Darby & Darby

[57] ABSTRACT

The invention relates to a folding box (10) for storing, transporting and displaying goods, in particular cosmetic or pharmaceutical products, having a first wall element (12), which is arched out convexly, a second wall element (14), which is arched out convexly in the opposite direction and is connected to the first wall element (12) via a folding line (20), a top-cover unit (30), which is designed to correspond to the arching of the wall elements (12, 14) and is connected via a folding line (34), and a base unit (40), which is designed to correspond to the arching of the wall elements (12, 14) and is connected via a folding line (44), and the invention is defined in that a first outer-wall element (16), which is connected via a second folding line (22), arranged parallel to the first folding line (20), is provided, a second outer-wall element (18), which is connected via a third folding line (24), arranged parallel to the first folding line (20), is provided, the first outer-wall element (16) is folded onto the outside of the first wall element (12), and fastened there, and the second outer-wall element (18) is folded onto the outside of the second wall element (14), and fastened there, and the top and bottom borders of the first outer-wall element (16) and/or of the second outer-wall element (18) run in a rectilinear manner.

8 Claims, 4 Drawing Sheets

FOLDING BOX

TECHNICAL FIELD

The present invention relates to a folding box for storing, transporting and displaying goods, in particular cosmetic or pharmaceutical products, having a first wall element, which is arched out convexly, a second wall element, which is arched out convexly in the opposite direction and is connected to the first wall element via a folding line, a top-cover unit, which is designed to correspond to the arching of the wall elements and is connected via a folding line, and a base unit, which is designed to correspond to the arching of the wall elements and is connected via a folding line.

PRIOR ART

Folding boxes of the type mentioned in the introduction with oval or lenticular outer cross-sectional contours are known. These folding boxes are not strong and, since they lack a standing surface, cannot be set upright, for example, inside a rack. As a result, such folding boxes, along with their contents, are often displayed to the potential customers in a basket.

DESCRIPTION OF THE INVENTION

The present invention is based on the object, or the technical problem, of designing a folding box of the type mentioned in the introduction such that a visually pleasing shape can be realized, straightforward production is possible, a high degree of stability can be ensured, and problem-free positioning and decorative presentation inside racks is possible. At the same time, it is intended that the folding box can be opened up, and filled with products, in as simple a manner as possible.

The folding box according to the invention is provided by the features of the independent claim 1. Advantageous configurations and developments form the subject matter of the dependent claims.

Accordingly, the folding box according to the invention is distinguished in that a first outer-wall element, which is connected via a second folding line, arranged parallel to the first folding line is provided, a second outer-wall element, which is connected via a third folding line, arranged parallel to the first folding line, is provided, the first outer-wall element is folded onto the outside of the first wall element, and fastened there, and the second outer-wall element is folded onto the outside of the second wall element, and fastened there, and the top and bottom borders of the first outer-wall element and/or the second outer-wall element run in a rectilinear manner.

The double-walled design means that the folding box according to the invention has a high degree of stability. As a result of the borders of the outer-wall elements running in a rectilinear manner, the oval surface can be used as a standing surface. Problem-free positioning and decorative presentation of the folding box according to the invention, along with its contents, in a sales rack or some other kind of display area, even in the upright position, is thus possible.

A particularly preferred configuration, which provides a further increase in the stability of the folding box, is distinguished in that the base unit has a first and a second base folding element, which are each respectively connected, via the curved folding line, to the first wall element and the second wall element, and one of the two base folding elements has an essentially central folding line, around which a region of the base folding element is folded inwards, and the inwardly folded region is connected, at least in certain areas, to the inside of the opposite base folding element, with the result that, when the definitive folded shape of the folding box is produced, the base unit is erected automatically and constitutes a double bottom.

As regards permanent dimensional stability, in particular in the base region, it has proved favorable to configure the folding box such that a wall-reinforcing flap is connected, via a folding line, in the base border region of the first and/or of the second outer-wall element and is fastened on the inside of the associated outer-wall elements.

A variant which has increased stability is distinguished, according to an inventive development, in that the first and/or the second top-cover folding element have/has at least one insertion flap, the first top-cover folding element and/or the second top-cover folding element preferably having at least one insertion flap.

A preferred variant which provides a clearly defined standing surface is distinguished in that, in the opened-up state of the folding box, the top and/or bottom border of the first outer-wall element and/or second outer-wall element project/projects beyond the top-cover unit and/or base unit, respectively. This feature makes the base unit and/or top-cover unit appear to be set back inwards, which also has a positive effect on the design quality.

A particularly preferred configuration is distinguished in that the first wall element and/or the second wall element have/has at least one recess. If the recesses are arranged one above the other, then it is possible, at least in some areas, to display the product located inside the folding box.

The folding box according to the invention is designed such that it is pre-folded into a flat state first of all and is delivered to the filling location in this pre-folded, flat state. In this flat transportation state, the first wall element has been folded onto the second wall element, the two base folding elements already having been connected, in some areas, to one another via adhesive bonding. The wall-reinforcing flaps are likewise folded over inwards and adhesively bonded to the inside of the outer-wall elements. The outer-wall elements, in turn, are folded onto the outsides of the corresponding wall elements, the entire side of the second outer-wall element being adhesively bonded to the second wall element. Simply by exerting pressure on the outer edges in the collapsed, flat state, the folding box is erected, i.e. the wall elements assume a form in which they are curved out convexly, the base unit being erected automatically. Once the product has been introduced, the final step is to fold the top-cover folding elements.

Further embodiments and advantages of the invention are given by the features outlined in more detail in the claims and by the exemplary embodiments specified hereinbelow. The features of the claims can be combined with one another as desired, as long as they are not obviously mutually exclusive.

BRIEF DESCRIPTION OF THE DRAWING

The invention and advantageous embodiments and developments of the same are explained and described in more detail with reference to the examples illustrated in the drawing. The features which can be gathered from the description and the drawing can be used, according to the invention, individually or in any desired combination. In the drawing.

METHODS OF IMPLEMENTING THE INVENTION

Figure 1:
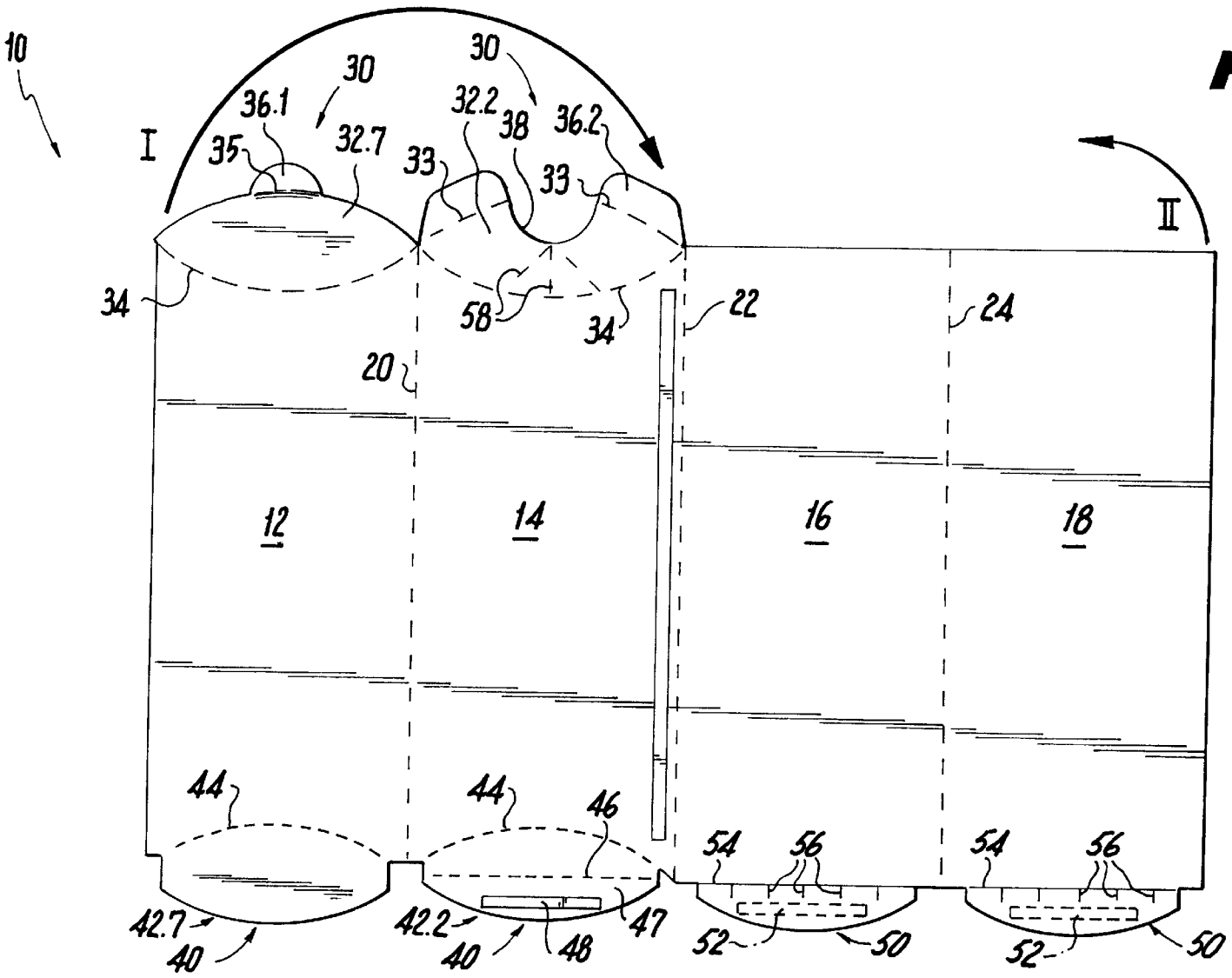
FIG. 1 shows a schematic illustration of the blank of a folding box with double-walled wall elements, a double-walled base unit and a double-walled top-cover unit.

According to the schematic illustration of the blank in FIG. 1, a folding box 10 has an elongate first wall element 12 on which there is integrally formed, via a folding line 20, a second wall element 14. A first outer-wall element 16 is connected to the second wall element 14 via a second folding line 22, which is arranged parallel to the first folding line 20. A second outer-wall element 18 is integrally formed on the first outer-wall element 16 via a third folding line 24, which is likewise arranged parallel to the folding line 20. The two outer-wall elements 16 and 18 have an essentially rectangular contour with a vertical extent which runs over the entire vertical extent of the folding box 10.

A base unit 40 is integrally formed on the underside of the first and second wall elements 12, 14, the base unit 40 comprising a base folding element 42.1, which is integrally formed on the first wall element 12 via a curved folding line 44, and a base folding element 42.2, which is integrally formed on the second wall element 14 via a curved folding line 44. The two base folding elements 42.1, 42.2 have an oval-shaped outer contour which is adapted to the arching of the wall elements 12, 14 and outer-wall elements 16, 18 in the opened-up state.

Along its axis of symmetry, the base folding element 42.2 has a folding line 46 which runs along essentially parallel to the bottom border, this producing, on the base folding element 42.2, a region 47 which can be folded over inwards. This region 47 also has an adhesive surface 48.

A top-cover folding element 32.1 and a top-cover folding element 32.2 are respectively integrally formed, via a curved folding line 34, on the first wall element 12 and on the second wall element 14, and together these top-cover folding elements form the top-cover unit 30. In its central outer region, the top-cover folding element 32.1 has a semicircular insertion flap 36.1 connected via a folding line 35. In its central region, the top-cover folding element 32.2 has a semicircular recess 38 and, in the adjoining outer border region, the top-cover folding element 32.2 has, on either side, in each case one insertion flap 36.2 which is integrally formed via a folding line 33.

In each case one wall-reinforcing flap 50 with a convexly curved outer contour is integrally formed, via a folding line 54, in the bottom border region of the first outer-wall element 16 and of the second outer-wall element 18. The two wall-reinforcing flaps 50 have an adhesive surface 52, with the result that they can be folded over inwards and can be adhesively bonded to the inside of the first outer-wall element 16 and of the second outer-wall element 18. Furthermore, the two wall-reinforcing flaps have scores 56 which are arranged at regular intervals and run perpendicularly with respect to the bottom border.

In addition, the second wall element 14 has a strip-like adhesive surface 62, in the border region towards the second folding line 22. The adhesive surfaces 48, 62 according to FIG. 1, which are visible to the viewer, are illustrated by solid lines in FIG. 1. The adhesive surfaces 52, which are not visible, are illustrated by dashed lines.

Once the blank has been produced, the folding box 10 can be pre-folded into a flat form. In this state, it can be delivered to the filling location.

Taking FIG. 1 as the starting point, the prefolding operation proceeds as follows. First of all the inner region 47 of the base folding element 42.2 is folded over inwards, i.e. in FIG. 1 away from the viewer, around the folding line 46. Thereafter, the first wall element is folded, in the arrow direction I, onto the second wall element 14 around the first folding line 20, as a result of which the adhesive surface 48 is connected to the inside of the base folding element 42.1. At the same time, the wall-reinforcing flaps 50 are folded over inwards, i.e. away from the viewer, along their folding lines 54 and are adhesively bonded to the insides of the corresponding outer-wall elements 16 and 18. In this state, the outer-wall elements 16, 18 are folded onto the wall elements 12, 14 (arrow II). In this case, the inside of the first outer-wall element 16 comes to rest on the outside of the first wall element 12. The inside of the second outer-wall element 18 likewise comes to rest on the outside of the second wall element 14, and at the same time the second outer-wall element 18 is connected to the second wall element 14 via the adhesive surface 62.

Figure 2:
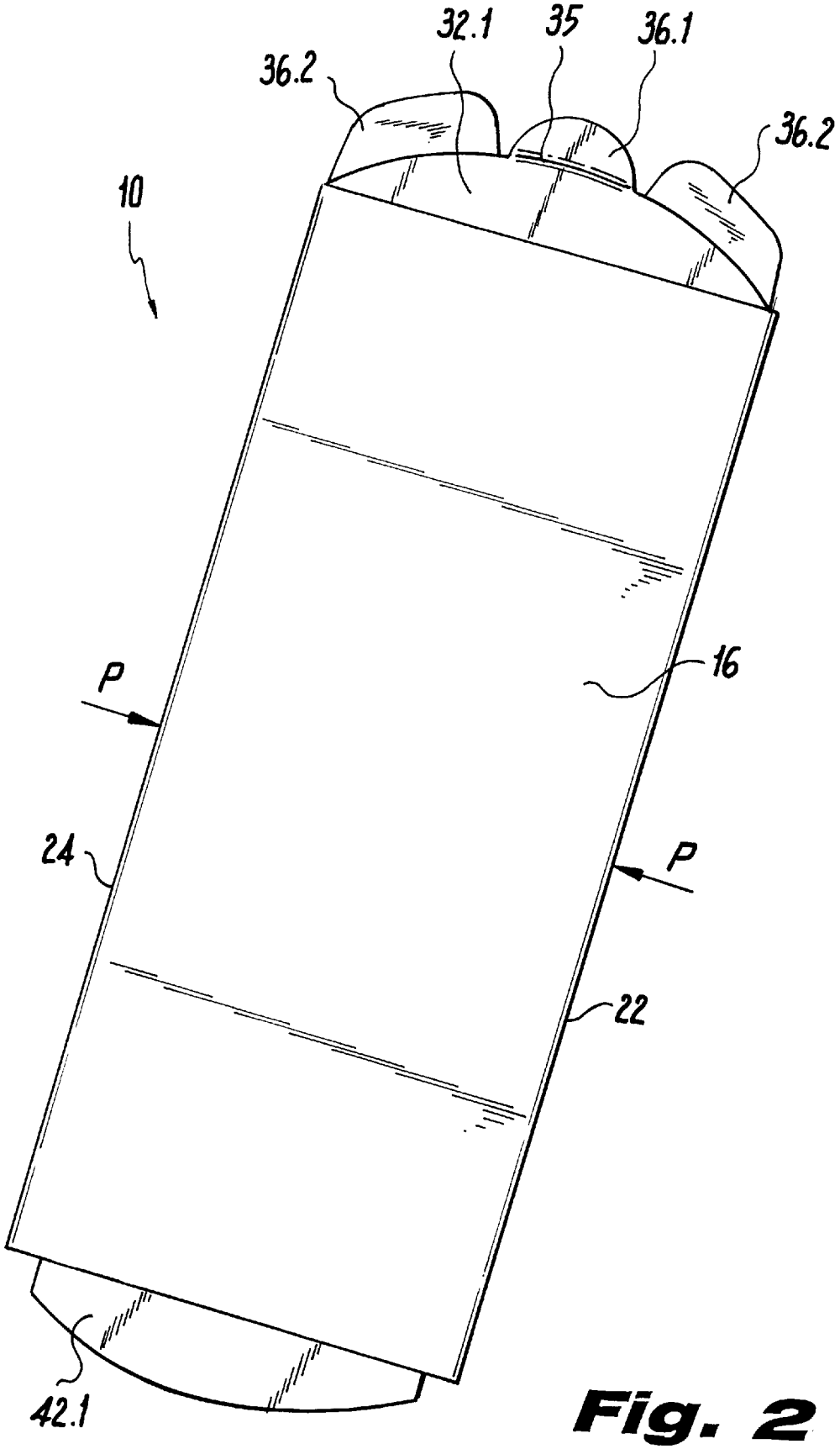
FIG. 2 shows a schematic plan view of the folding box, folded in the flat transportation state, according to the blank of FIG. 1, FIGS. 3–5 show schematic cross-sections through the folding box in the pre-folded, flat transportation state (FIG. 3), in an intermediate state during the folding operation (FIG. 4) and in the opened-up state without any product introduced therein (FIG. 5)
Figure 3:
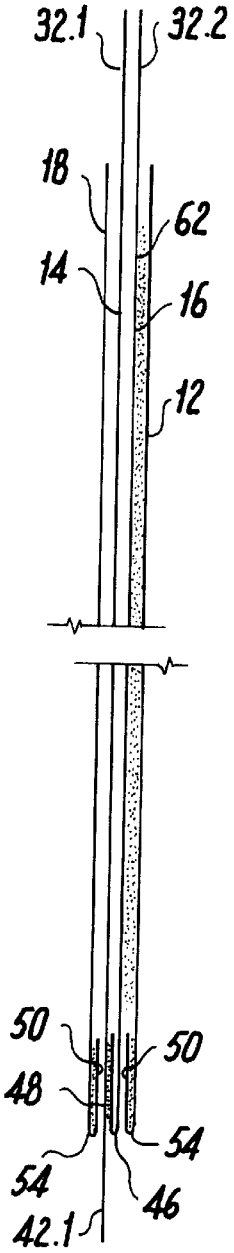
Figure 4:
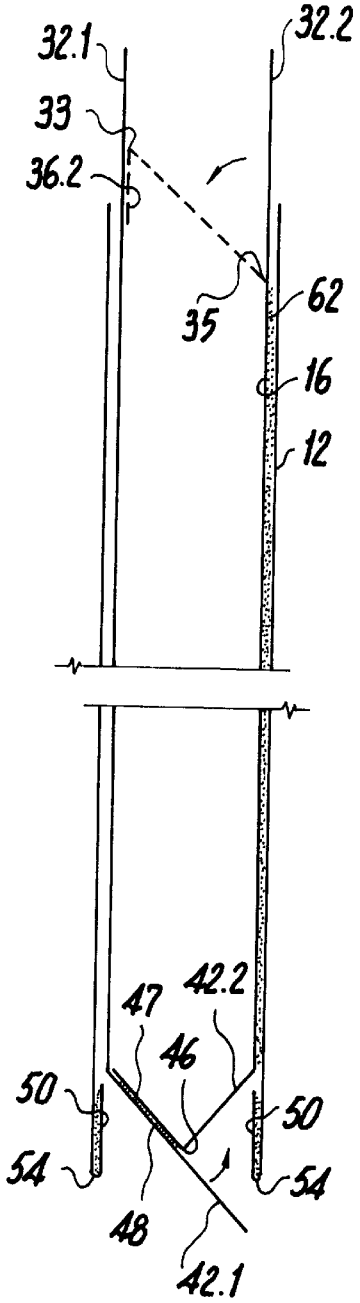

After this folding operation, the folding box 10 is located in a flat folded state, which is illustrated in FIGS. 2 and 3. In order to open up the folding box 10, pressure is exerted, in arrow direction P, on the opposite outer edges of the flat folding box 10 according to FIG. 2, as a result of which the wall elements 12, 14, 16, 18 arch out convexly and the base unit 40 is erected automatically.

Figure 5:
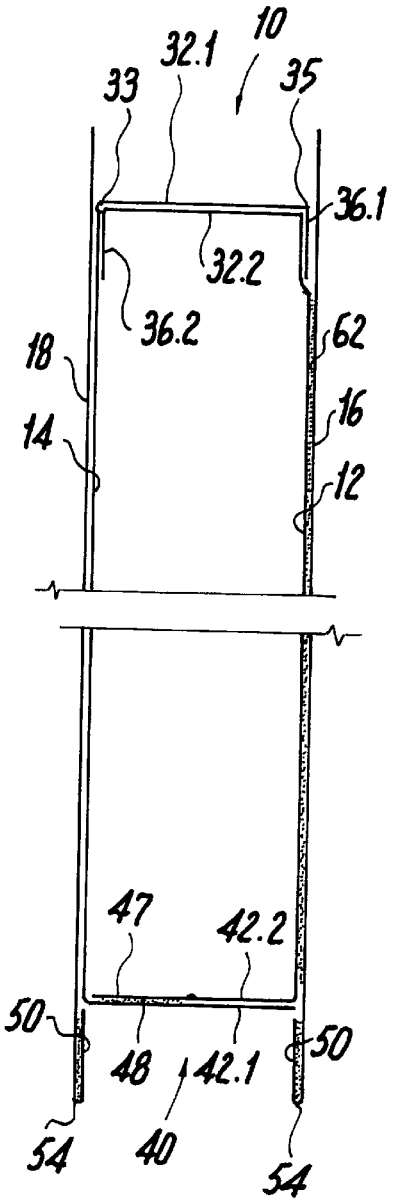
Figure 6:
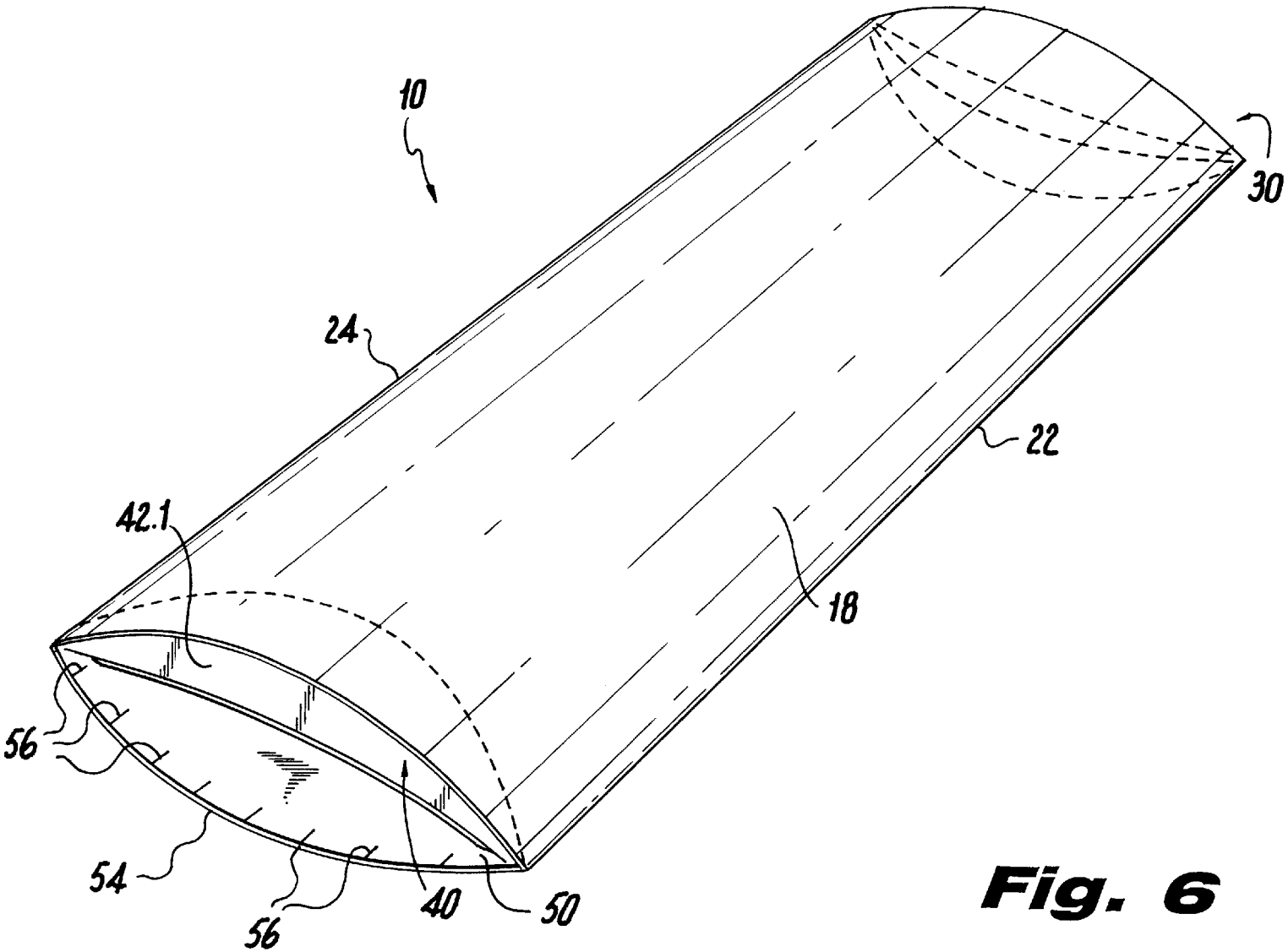
FIG. 6 shows a schematic perspective illustration of the folding box according to FIG. 5 in the opened-up state.

Once the base unit 40 has been erected, the folding box 10 can be filled. Thereafter, the insertion flaps 36.2 of the top-cover folding element 32.2 are folded downwards and the top-cover folding element 32.2 as a whole is folded inwards. After this, the top-cover folding element 32.1, once its insertion flap 36.1 has been folded over, is likewise folded over inwards, and this gives the folded state which is illustrated in cross-section in FIG. 5 or the folded state which is illustrated schematically in perspective in FIG. 6.

The border contours of the outer-wall elements 16 and 18 are geometrically designed such that they project beyond the base unit 40 and/or the top-cover unit 30 in the opened-up state. The provision of additional wall-reinforcing flaps 50 in the base region increases the stability, and a clearly defined oval standing surface is provided at the same time as a result of the projecting outer-wall elements 16, 18. At the same time, the wall-reinforcing flap 50 prevents the base folding element 42.2, and thus the base unit 40 as a whole, from folding outwards again.

We claim:

1. A folding box (10) for storing, transporting and displaying goods, in particular cosmetic or pharmaceutical products, having a first wall element (12), which is arched out convexly, a second wall element (14), which is arched out convexly in the opposite direction and is connected to the first wall element (12) via a folding line (20), a top-cover unit (30), which is designed to correspond to the arching of the wall elements (12, 14) and is connected via a folding line (34), and a base unit (40), which is designed to correspond to the arching of the wall elements (12, 14) and is connected via a folding line (44), wherein a first outer-wall element (16), which is connected via a second folding line (22), arranged parallel to the first folding line (20), is provided, a second outer-wall element (18), which is connected via a third folding line (24), arranged parallel to the first folding line (20), is provided, the first outer-wall element (16) is folded onto the outside of the first wall element (12), and fastened there, and the second outer-wall element (18) is folded onto the outside of the second wall element (14), and fastened there, and the top and bottom borders of the first outer-wall element (16) and/or of the second outer-wall element (18) run in a rectilinear manner.

2. The folding box as claimed in claim 1, wherein the base unit (40) has a first and a second base folding element (42.1, 42.2), which are each respectively connected, via the curved folding line (44), to the first wall element (12) and the second wall element (14), and one of the two base folding elements (42.2) has an essentially central folding line (46), around which a region (47) of the base folding element (42.2) is folded inwards, and the inwardly folded region (47) is connected, at least in certain areas, to the inside of the opposite base folding element (42.1), with the result that, when the definitive folded shape of the folding box (10) is produced, the base unit (40) is erected automatically and constitutes a double bottom.

3. The folding box as claimed in claim 1, wherein a wall-reinforcing flap (50) is connected, via a folding line (54), in the base border region of the first and/or of the second outer-wall element (16, 18) and is fastened on the inside of the associated outer-wall elements (16, 18).

4. The folding box as claimed in claim 1, wherein the top-cover unit (30) has a first and a second top-cover folding element (32.1, 32.2), which are each respectively integrally formed, via a curved folding line (34), to the first wall element and to the second wall element (14).

5. The folding box as claimed in claim 4, wherein the first and/or the second top-cover folding element (32.1. 32.2) have/has at least one insertion flap (36.1, 36.2).

6. The folding box as claimed in claim 1, wherein, in the opened-up state of the folding box (10), the top and/or bottom border of the first outer-wall element (16) and/or second outer-wall element (19) project/projects beyond the top-cover unit (30) and/or base unit (40), respectively.

7. The folding box as claimed in claim 1, wherein the first wall element (12) and/or the second wall element (14) and/or the first outer-wall element (16) and/or the second outer-wall element (18) have/has at least one recess.

8. The folding box as claimed in claim 1, wherein the elements are fastened to one another by adhesive bonding.

* * * * *

UNITED STATES PATENT AND TRADEMARK OFFICE

CERTIFICATE OF CORRECTION

PATENT NO. : 5,911,358
DATED : June 15, 1999
INVENTOR(S) : Ralf Kenner, et al

It is certified that error appears in the above-identified patent and that said Letters Patent is hereby corrected as shown below:

On the title page: Item [30] Foreign Application Priority Data, change "29709510 U" to -- 29709510--.

Signed and Sealed this
Fourth Day of January, 2000

*Attest:*

*Attesting Officer*

*Acting Commissioner of Patents and Trademarks*